United States Patent [19]

Geissler

[11] Patent Number: 4,613,835

[45] Date of Patent: Sep. 23, 1986

[54] REFLECTION PHASE SHIFTER

[75] Inventor: Rainer Geissler, Niederdorfelden, Fed. Rep. of Germany

[73] Assignee: ANT Nachrichtentechnik GmbH, Backnang, Fed. Rep. of Germany

[21] Appl. No.: 725,750

[22] Filed: Apr. 22, 1985

[30] Foreign Application Priority Data

Apr. 27, 1984 [DE] Fed. Rep. of Germany ..... 3415674

[51] Int. Cl.[4] ..... H01P 1/18

[52] U.S. Cl. ..... 333/159; 333/157; 333/164; 333/248

[58] Field of Search ..... 333/156, 157, 159, 164, 333/248, 250, 253, 263; 332/16 R, 29 R, 30 R

[56] References Cited

U.S. PATENT DOCUMENTS

| | | | |
|---|---|---|---|
| 3,452,255 | 6/1969 | Neale et al. | 317/234 |
| 3,521,203 | 7/1970 | Sharpless | 333/250 |

FOREIGN PATENT DOCUMENTS

| | | |
|---|---|---|
| 0090694 | 10/1983 | European Pat. Off. . |
| 2618785 | 11/1977 | Fed. Rep. of Germany . |
| 2134610 | 12/1972 | France . |
| 672543 | 5/1952 | United Kingdom . |
| 1180196 | 2/1970 | United Kingdom . |
| 2018078 | 10/1979 | United Kingdom . |

OTHER PUBLICATIONS

E. Kpodzo et al, "Mikrowellen Magazin (Microwave Magazine) vol. 8, No. 6, 1982, pp. 688-690.

*Primary Examiner*—Marvin L. Nussbaum

*Attorney, Agent, or Firm*—Spencer & Frank

[57] ABSTRACT

A reflection phase shifter connectable to a waveguide for shifting the phase of a high frequency signal received from the waveguide. The phase shifter includes a waveguide section having two pairs of opposite side walls and an end wall forming a short-circuit. The side walls define a cavity and an opening opposite to the end wall for communication with the waveguide. The waveguide section has a broad dimension between one pair of opposite side walls corresponding to the width dimension of the waveguide and a narrow dimension between the other pair of opposite side walls which is smaller than the height dimension of the waveguide. A switchable semiconductor arrangement, including a switching semiconductor element and a housing for accommodating the switching semiconductor element, is adjustably mounted in a side wall of the waveguide section and penetrates into the said cavity with a controllable penetration depth for tuning said waveguide section for a desired phase angle shift. A tuning pin is mounted in a side wall of the waveguide section so that the tuning pin is disposed opposite the switchable semiconductor arrangement.

6 Claims, 2 Drawing Figures

REFLECTION PHASE SHIFTER

BACKGROUND OF THE INVENTION

The present invention relates to a reflection phase shifter composed of a short-circuited, reduced height waveguide in which there is disposed at least one switchable semiconductor element accommodated in a housing and wherein at least one tuning pin extends into the reduced height waveguide.

Such a reflection phase shifter is disclosed in the periodical *Mikrowellen Magazin* [Microwave Magazine], volume 8, No. 6, 1982, pages 688–690. In that phase shifter, the semiconductor element accommodated in the housing is a PIN diode which is fixed in a reduced height waveguide. However, this waveguide also has a reduced width so that it acts as a reverse-wave blocking waveguide. A plurality of tuning pins extending into the reverse-wave blocking waveguide are required to set the phase shifter to a desired phase angle and to tune the phase angle over a broad frequency band.

SUMMARY OF THE INVENTION

It is an object of the present invention to provide a reflection phase shifter of the above-mentioned type which is able to operate with fewer tuning pins so that it can be set to a desired phase angle over a broad band.

The above and other objects are accomplished in accordance with the invention wherein there is provided a reflection phase shifter connectable to a waveguide for shifting the phase of a high frequency signal received from the waveguide, the waveguide having height and width dimensions, with the phase shifter including:

a waveguide section having two pairs of opposite side walls and an end wall forming a short-circuit, the side walls defining a cavity and an opening opposite to the end wall for communication with the waveguide, the waveguide section having a broad dimension between one pair of opposite side walls corresponding to the width dimension of the waveguide and a narrow dimension between the other pair of opposite side walls which is smaller than the height dimension of the waveguide;

a switchable semiconductor arrangement, including a switching semiconductor element and a housing for accommodating said switching semiconductor element, adjustably mounted in a side wall of the waveguide section and penetrating into the cavity with a controllable penetration depth for tuning the waveguide section for a desired phase angle shift; and a tuning pin mounted in a side wall of the waveguide section so that the tuning pin is disposed opposite the switchable semiconductor arrangement.

The reflection phase shifter according to the present invention has the advantage that it can be tuned very easily and quickly since it requires relatively few tuning means.

BRIEF DESCRIPTION OF THE DRAWINGS

The invention will now be described in greater detail wirh reference to an embodiment illustrated in the drawings.

DESCRIPTION OF THE PREFERRED EMBODIMENT

Figure 1:
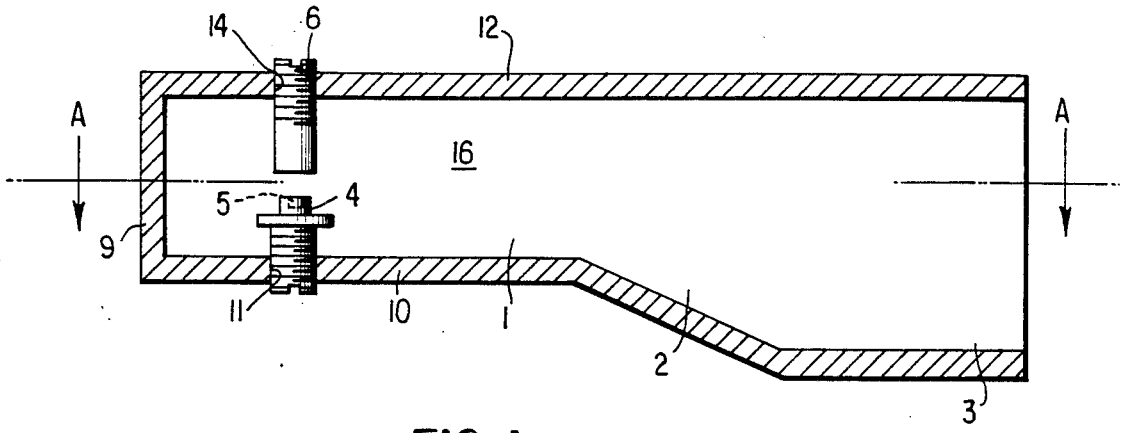
FIG. 1 is a longitudinal sectional view taken through the broadside of an embodiment of a reflection phase shifter according to the invention.
Figure 2:
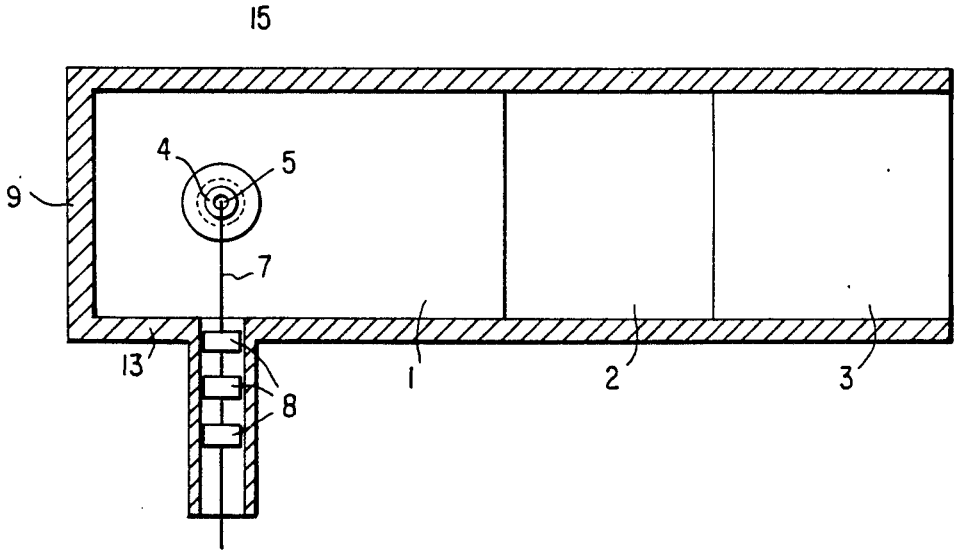
FIG. 2 is a longitudinal sectional view along line A—A of FIG. 1 taken through the narrow side of the reflection phase shifter according to the invention.

The reflection phase shifter shown in FIGS. 1 and 2 is composed of a rectangular waveguide section 1 closed at one end by a wall 9 forming a short-circuit. Waveguide section 1 opens at its other end into a waveguide section 2 having a linearly expanding cross section which in turn opens into a waveguide 3 having cross-sectional dimensions designed for the operating frequency. Waveguide section 1 is reduced in height between side walls 10 and 12 relative to waveguide 3, however, the width between side walls 13 and 15 of waveguide section 1 corresponds to the width of waveguide 3 as shown in FIG. 2. Reduced height waveguide section 1 receives a high frequency signal from waveguide section 3 via waveguide section 2. The signal is reflected in waveguide section 1 and thereby suffers a certain shift in phase whereupon it returns again to waveguide section 3 through waveguide section 2.

In waveguide section 1 there is provided a switchable semiconductor element, preferably a PIN diode 5, which is accommodated in a housing 4. Due to the reduction in height of waveguide section 1 in which diode 5 is disposed, the waveguide line impedance is reduced so that better coupling is possible between the diode and the waveguide. Housing 4 with PIN diode 5 projects through wall 10, which is on the broadside of waveguide section 1, and is adjustably held in waveguide wall 10 by, for example, a screw-in connection 11, so that the penetration depth of housing 4 can be varied. Housing 4, with its variable penetration depth, performs the function of a tuning device.

The phase angle of the reflected signal can be set to be in a desired range by way of controlling the depth of penetration of housing 4 into reduced height waveguide section 1. For example, housing 4 can be brought into such a position that in a frequency band from 17.7 GHz to 19.7 GHz, the phase-frequency characteristic covers an angular range from 70° to 110°.

As shown in FIG. 1, an adjustable tuning pin 6, made preferably of sapphire, is provided in the waveguide wall 12 directly opposite housing 4. Sapphire exhibits a significantly better broad band tuning behavior than previously used metal tuning pins which have been found to produce undesirable resonances. The pitch of the phase-frequency characteristic is function of the depth of penetration of tuning pin 6 into reduced height waveguide section 1. In order for the phase shifter to cover a broad band, tuning pin 6 must be set so that the phase-frequency characteristic becomes level over the largest possible frequency range. Because the diode impedance is compensated by the tuning pin 6 which is located directly opposite diode 5, frequency dependency due to line transformations is avoided so that the arrangement has a very broad bandwidth.

The reflection phase shifter of the invention can thus be tuned over a broad band to a desired phase shift solely by the adjustable housing 4 of the PIN diode 5 and a single tuning pin 6 disposed directly opposite diode 5.

As can be seen in FIG. 2 which shows a sectional view along line A—A in FIG. 1, the PIN diode 5 receives its voltage supply through a wire 7 guided through side wall 13 which is perpendicular to the waveguide wall 10 which is penetrated by housing 4 of the PIN diode 5. Wire 7 should be very thin so as to minimize interference with the field in the reduced height waveguide section 1. The length of wire 7 is approximately one quarter of the operating wavelength λ in a coaxial line so that the short-circuit of a lowpass filter connected to the wire in the form of a conventional λ/4 radial line transformer 8 (choke structure), is transformed into idling at PIN diode 5 (at waveguide frequency).

The cross-sectional dimensions of waveguide 3 are 4.3 mm × 10.6 mm.

The cross-sectional dimensions of reduced hight waveguide 1 are 3 mm × 10.6 mm.

The diameter of housing 4 of th PIN diode 5 is 2 mm.

The diameter of tuning pin 6 is 1.6 mm.

The distance between the housing 4 and the short-circuit wall 9 is λ/8.

It will be understood that the above description of the present invention is susceptible to various modifications, changes and adaptations, and the same are intended to be comprehended within the meaning and range of equivalents of the appended claims.

What is claimed is:

1. A reflection phase shifter connectable to a waveguide for shifting the phase of a high frequency signal received from the waveguide wherein the waveguide has height and width dimensions, said phase shifter comprising:

a waveguide section having two pairs of opposite side walls and an end wall forming a short-circuit, said side walls defining a cavity and an opening opposite to said end wall for communication with the waveguide, said waveguide section having a broad dimension between one pair of opposite side walls corresponding to the width dimension of the waveguide and a narrow dimension between the other pair of opposite side walls which is smaller than the height dimension of the waveguide;

a switchable semiconductor arrangement, including a switching semiconductor element and a housing for accommodating said switching semiconductor element, adjustably mounted in a side wall of said waveguide section and penetrating into said cavity with a controllable penetration depth for tuning said waveguide section for a desired phase angle shift; and a tuning pin mounted in a side wall of said waveguide section so that said tuning pin is disposed opposite said switchable semiconductor arrangement.

2. Reflection phase shifter as defined in claim 1, wherein said tuning pin is made of sapphire.

3. Reflection phase shifter as defined in claim 1, wherein said semiconductor element is a PIN diode.

4. Reflection phase shifter as defined in claim 1, wherein said switchable semiconductor arrangement and the tuning pin are disposed in the opposite side walls which form the broad dimension of said waveguide section.

5. Reflection phase shifter as defined in claim 1, including a wire which is brought through a side wall of said waveguide section which is disposed perpendicularly to the side wall penetrated by said switchable semiconductor arrangement, and wherein said switchable semiconductor element is connected to said wire for receiving a supply voltage.

6. Reflection phase shifter as defined in claim 5, wherein said wire has approximately the length of one quarter of the operating wavelength in a coaxial line and further including a lowpass filter to which said wire is connected.

* * * * *